United States Patent [19]

Inaba

[11] Patent Number: 4,688,721

[45] Date of Patent: Aug. 25, 1987

[54] EXTENSIBLE AND CONTRACTIBLE DOUBLE STRAW

[76] Inventor: Koichi Inaba, 1994 Denpo Takishita, Fuji-shi Shizuoka-ken, Japan

[21] Appl. No.: 833,069

[22] Filed: Feb. 26, 1986

[30] Foreign Application Priority Data

Mar. 8, 1985 [JP] Japan ..... 60-32897[U]

[51] Int. Cl.[4] ..... A47G 21/18; F16L 15/02

[52] U.S. Cl. ..... 239/33; 285/165

[58] Field of Search ..... 239/33; 285/165, 302, 285/DIG. 22; 138/120

[56] References Cited

U.S. PATENT DOCUMENTS

| | | | |
|---|---|---|---|
| 1,150,407 | 8/1915 | Wells | 285/302 X |
| 2,288,848 | 7/1942 | Schuessler | 239/33 |
| 4,135,274 | 1/1979 | Freeman | 285/298 X |
| 4,258,884 | 3/1981 | Rogers | 285/DIG. 22 |

FOREIGN PATENT DOCUMENTS

| | | | |
|---|---|---|---|
| 895505 | 5/1962 | United Kingdom | 285/302 |

*Primary Examiner*—Andres Kashnikow
*Assistant Examiner*—Patrick N. Burkhart
*Attorney, Agent, or Firm*—Price, Heneveld, Cooper, DeWitt & Litton

[57] ABSTRACT

A straw of telescopic construction permits the straw, when collapsed, to be no longer than a beverage container to which it is attached but long enough, when extended, to reach the container's bottom and extend beyond the top of the container. The straw includes means to prevent the inner straw being pushed through the bottom end of the outer straw and a structure which interlocks to positively hold the extended straws in extended position against inadvertent telescopic collapse. The structure includes an air seal at the straw juncture when they are fully extended.

5 Claims, 5 Drawing Figures

EXTENSIBLE AND CONTRACTIBLE DOUBLE STRAW

FIELD OF THE INVENTION

The present invention relates to an improvement in extensible and contractible double straws for drinking liquids which straws consist of an inner straw and an outer straw telescopically slidable relative to each other.

BACKGROUND OF THE INVENTION

A straw to be attached to a beverage container preferably should be longer than the depth of the container to prevent the straw from falling into the container during drinking. However, a straw sufficiently long to be convenient for drinking all of the contents of a particular container will necessarily be longer than the beverage container itself, and consequently, it is difficult to attach such a straw to the container in a convenient manner. As a result, there is a demand for a straw which is contractible for attachment to the container and extensible for use. The extensible and contractible double straw well known in the art consists of an inner straw and an outer straw of a relatively simple construction. The outer straw has one end formed with a portion of reduced diameter while the inner straw has one end portion formed with an enlarged diameter so that these two portions engage each other when these inner and outer straws have been fully telescopically extended. In consequence, practical use of such extensible and contractible double straws of prior art has often been accompanied by problems described in the following paragraphs.

For drinking, such a double straw is telescopically extended to form a unitary straw and then inserted into the beverage container. Proper extension of the double straw is achieved by extending the inner straw in a normal direction or in the direction toward the front end. However, the inner straw becomes separated from the outer straw if the inner straw is carelessly extended in the opposite direction. Additionally, the double straw of the prior art has not been provided with means to hold the straw in fully extended position or to prevent the straw from readily contracting. Thus, a pressure unintentionally applied to the straw during drinking might cause the complete straw to drop into the container.

In view of such problems, the inventor has already proposed in Japanese Utility Model Application No. 58-127196 an extensible and contractible double straw consisting of an inner straw having its base end formed as a portion of enlarged diameter and an outer straw having its front end formed as a portion of reduced diameter so as to assure engagement of the base end of the inner straw with the front end of the outer straw when these inner and outer straws have been telescopically fully extended, wherein the outer straw is provided adjacent the front end thereof with an inwardly directed stopper to prevent the inner straw from retracting into the outer straw and the outer straw is further provided at the base end with a portion of reduced diameter to prevent the inner straw from slipping out of or separating from the outer straw.

The improved straw disclosed in the above-mentioned application is adequately effective in that the inner straw is effectively prevented from separating from the outer straw and, in the extended state, the inner straw is held against retracting back into the outer straw. However, even this improved straw has proved to have several problems due to said inwardly directed stopper which has been construted merely as an inwardly directed projection. More specifically, the portion of enlarged diameter formed along the base end of the inner straw cannot move smoothly beyond said stopper when said inner straw is withdrawn from the outer straw for fully extending the double straw, also, sometimes the double straw may be used without complete engagement of the inner straw with the outer straw. There has occurred even a case in which the inner straw was withdrawn with excessive force to overcome the difficulty in moving the base end of the inner straw beyond said stopper and, as a consequence, said base end of enlarged diameter is moved beyond the front end of the outer straw which was formed as the portion of reduced diameter.

The present invention provides a further improvement in view of the above-mentioned problems, in that the inner straw is effectively prevented from readily separating from the outer straw and the double straw is reliably restrained against easily contracting again once the double straw has been fully extended with the base end of the inner straw forming the portion of enlarged diameter smoothly sliding beyond the inwardly directed stopper of the outer straw.

According to the present invention, this object is achieved, in an extensible and contractible double straw consisting of an inner straw having its base end formed as a portion or enlarged diameter and an outer straw having its front end formed as a portion of reduced diameter so as to assure engagement of the base end of the inner straw with the front end of the outer straw when these inner and outer straws have been fully extended in a telescopic manner. In this arrangement, the outer straw is provided, adjacent the front end thereof, with an inwardly directed stop to prevent the inner straw from retracting into the outer straw and the outer straw is further provided at the base end with a portion of reduced diameter to prevent the inner straw from separating from the outer straw. In this improvement, the inwardly directed stop provided by the outer straw includes a gentle slope facing the base end and a steep slope facing the front end of said outer straw.

DESCRIPTION OF THE PREFERRED EMBODIMENT

Figure 1:
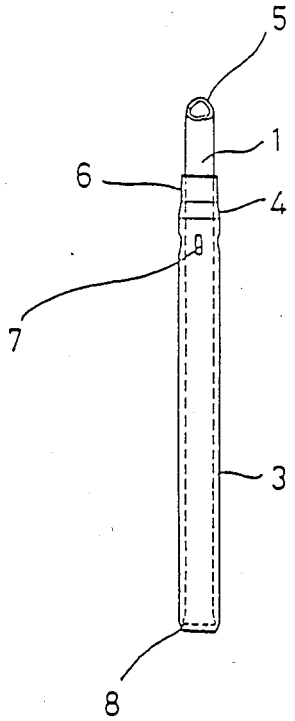
FIG. 1 is a side elevation view of the invention retracted into storage position.

The above-mentioned and other features of the present invention will be apparent from the following description of a preferred embodiment in reference with the accompanying drawings.

As seen in the drawing, an extensible double straw consists of an inner straw 1 and an outer straw 3. A front or outer end of the inner straw 1 is obliquely cut away to form a pointed end 5 in order to facilitate not only insertion of the extensible and contractible double straw into a beverage container but also assembly of the double straw, i.e., insertion of the inner straw 1 into the outer straw 3. A base end of the inner straw 1, namely, the end of the inner straw 1 destined to be engaged with the outer straw 3 is formed as a diameter enlarged or outwardly flared portion 2.

The end of the outer straw 3 destined to be engaged with the inner straw 1, namely, the front end of this outer straw 3, is formed with a portion 4 of reduced diameter and this portion of reduced diameter extends a suitable length in the direction the inner straw 1 is extended, forming a tapered portion 6. The inner diameter of this tapered portion 6 is so dimensioned that does not obstruct the sliding movement of the inner straw 1 and substantially corresponds to the outer diameter of said inner straw 1. Thus, when the straw is fully extended, the enlarged diameter or flared portion 2 of the inner straw 1 engages the reduced diameter portion 4 of the outer straw 3, whereby the inner straw 1 is prevented from disengaging the outer straw 3. In addition, the inner straw 1 is also supported by the tapered portion 6 of the outer straw 3. A possible bending of these inner and outer straws at the point of engagement is thus effectively prevented.

The outer straw 3 adjacent its front end has inwardly directed stops 7 to prevent the extended inner straw 1 from retracting back into the outer straw 3 when the double straw has been fully extended. The base end of the outer straw 3 also is formed with a portion 8 of reduced diameter to prevent the inner straw once retracted into the outer straw 3 from unintentionally sliding out of the outer straw 3.

As a substantial feature of the present invention, said inwardly directed stops 7 of the outer straw 3 are defined by a gentle slope 9 facing the base end and a steep slope 10 facing the front end.

Although said inwardly directed stop 7 is shown in the form of four inwardly directed projections, the number of these projections may be more or less than four and may be replaced by a ring-shaped stop extending around the peripheral wall of the outer straw.

Figure 2:
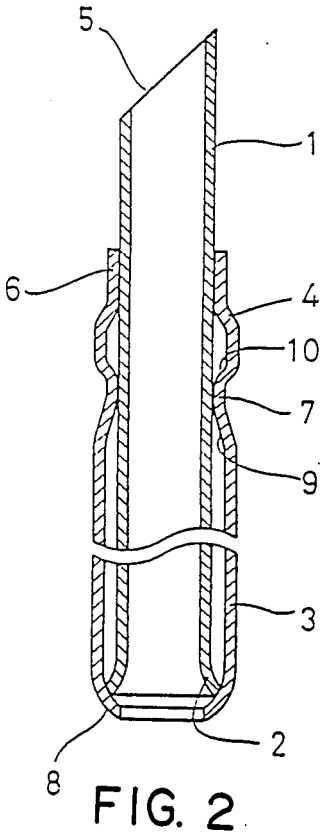
FIG. 2 is a broken, enlarged central sectional view of the invention retracted into storage position.

To assemble the extensible and contractible double straw of this invention, constructed as has been described hereinabove, the obliquely pointed end 5 of the inner straw 1 may be inserted into the base end of the outer straw 3 and then further pushed thereinto until the diameter enlarge base end portion 2 of the inner straw 1 passes through the diameter reduced base end portion 8 of the outer straw 3. The straw is made of synthetic resin and, therefore, said portion 2 of enlarged diameter can rather easily pass through said portion 8 of reduced diameter, when the inner straw 1 is somewhat forcibly pushed into the outer straw 3. At this point, the front end of the inner straw 1 slightly projects through the front end of the outer straw 3 (FIGS. 1 and 2). Thus, the projecting front end of the inner straw 1 may be grasped and pulled until the enlarged diameter base end portion 2 of the inner straw 1 passes over the inwardly directed stops 7 located adjacent the front end of the outer straw and into engagement with the portion of reduced diameter of the outer straw to attain the fully extended state. Once such a state has been attained, a normal force applied to the inner straw 1 with the intention of contracting the double straw would be well resisted by engagement of the portion 2 of enlarge diameter of the inner straw 1 with the inwardly directed stops 7 of the outer straw 3 and thereby said inner straw 1 is reliably held against retraction into the outer straw 3. Thus, the double straw is kept fully extended and the possibility of unintentional retraction of the double straw during drinking is substantially reduced.

Owing to the above-mentioned feature, unique to the present invention, that said inwardly directed stops 7 have their gentle slopes 9 facing the base end and the steep slope 10 facing the front end, the enlarged or flared base end 2 of the inner straw 1 can ride smoothly past the inwardly directed stops 7 along said gentle slope 9 and, once said base end 2 of enlarge diameter has moved beyond said stops 7, said steep slope 10 locks said base end 2 so that the inner straw cannot easily retract into the outer straw and the fully extended state can be reliably maintained.

With the improvement in the extensible double straw according to the present invention, as will be apparent from the foregoing description, the base end portion of reduced diameter of the outer straw advantageously holds the assembled inner and outer straws in their retracted condition by preventing the inner straw, once inserted into the outer straw from disengaging from the outer straw. Also, the inwardly directed stops 7 formed in and adjacent to the front end of the outer straw advantageously serves to keep the double straw in the fully extended condition by preventing the inner straw from retracting into the outer straw. These features enable the double straw to be reliably handled. Furthermore, as a most important feature of the present invention, the inwardly directed stops are characterized by gentle slopes facing the base end and steep slopes facing the front end, so that the enlarged diameter portion of the inner straw can smoothly move past these inwardly directed stops when the inner straw is extended from the outer straw.

Figure 3:
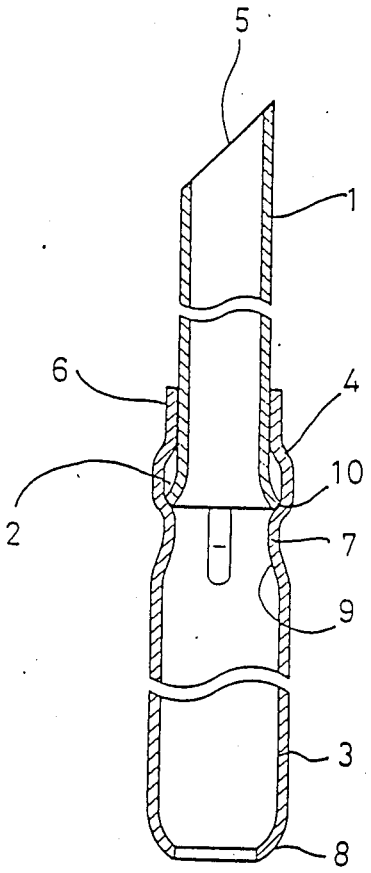
FIG. 3 is a view similar to FIG. 2 except illustrating the invention in fully extended position.
Figure 4:
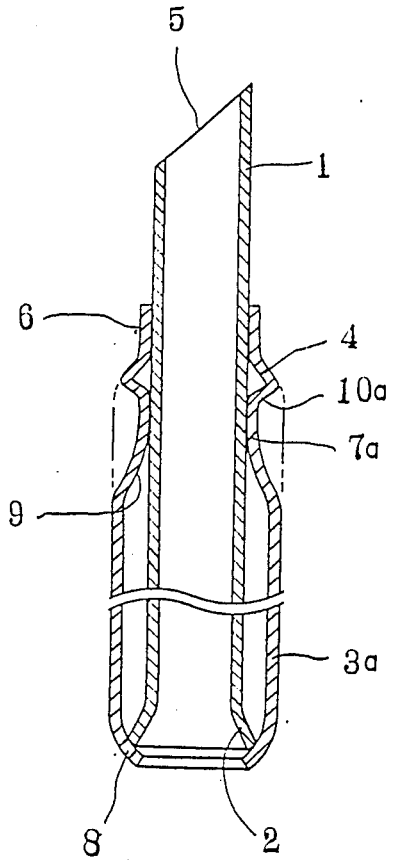
FIG. 4 is a broken enlarged central sectional view similar to FIG. 2 illustrating a modified embodiment of the invention; showing the straw in retracted position.
Figure 5:
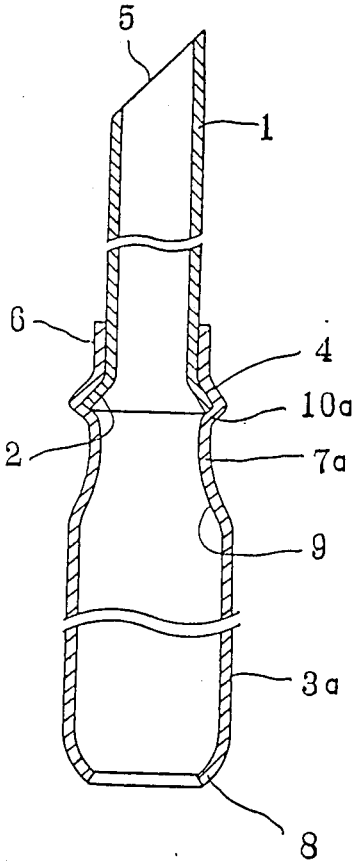
FIG. 5 is a view of the same straw as illustrated in FIG. 4 except showing the straw in fully extended position.

In another embodiment shown in FIGS. 4 and 5, members corresponding to those in FIGS. 1–3 are designated by the same reference numerals. Those members having a modified construction and identified by an "a" suffix. The difference between the embodiment of FIGS. 1–3 and the embodiment illustrated in FIGS. 4 and 5 is in the shape of the interengaging portions when the inner straw is fully extended. In the modified construction, the gentle slope 10 of the stops **7*a* terminates abruptly in a radially outwardly extending trap having a generally V-shape. Because of this structure, when the inner straw 1 is fully extended as shown in FIG. 5, the end edge of the flared portion 2 of the inner straw 1 seats tightly in the bottom of the V-shaped trap and against the steep slope 10*a*. This forces the flared portion 2 into close contact with the inner face of the reduced portion 4 of the outer straw 3*a*** so that an airtight condition between the inner and outer straws is created and maintained.

In the embodiment included in FIGS. 4 and 5, the length of the stops 7 is increased longitudinally of the straw, whereby the strength of the stop is increased, increasing the force with which the flared portion 2 is engaged, resulting in greater resistance to retraction of the inner straw.

I claim:

1. A telescopic beverage straw having inner and outer tubular members; said inner tubular member having a radially outwardly flared lip on its inner end terminating in an outwardly inclined edge; the inner end of said outer straw having a beverage receiving opening of lesser diameter than said flared lip, the outer end of said outer member having a sleeve portion of a diameter to closely seat about said inner member and hold it against axial misalignment with respect to said outer member, said inner member being axially slidable with respect to said outer member; the inner end of said sleeve portion terminating in an outwardly extending shoulder, the improvement in said straw comprising: said shoulder providing an inwardly facing surface complementary to said outwardly inclined edge of said flared lip; an inwardly and progressively outwardly extending stop surface on said outer member facing said shoulder and inclined at an angle to seat against the edge of the flared lip, said stop surface in cooperation with said shoulder forming a trap chamber for receiving the flared lip of the inner member between it and the shoulder and of a size and shape to hold the inner member simultaneously against both extension and retraction when the straw is fully extended; the face of the stop surface facing the inner end of the inner member being sloped to form an inclined camming surface urging entry of said flared lip into said trap chamber and said outer face of the lip to seat against the inner surface of said shoulder to form a seal between said inner and outer members.

2. The telescopic beverage straw described in claim 1 wherein said stop surfaces are individual protrusions projecting radially inwardly arranged at circumferentially spaced intervals.

3. The telescopic beverage straw described in claim 1 wherein said stop surface is an inwardly extending annular ledge.

4. The telescopic beverage straw described in claim 1 wherein said shoulder and stop means are positioned adjacent each other to provide the trap chamber with a radially outwardly extending channel of generally V-shape cross section and of a size just large enough to seat the end edge lip of the inner straw in the apex of said channel.

5. The telescopic beverage straw described in claim 1 wherein both said shoulder and said stop surface are continuous walls extending entirely around the circumference of said outer member.

* * * * *